US011081250B2

(12) United States Patent
Harmon et al.

(10) Patent No.: US 11,081,250 B2
(45) Date of Patent: Aug. 3, 2021

(54) APPARATUSES AND METHODS FOR SECURELY STORING RADIOACTIVE SOURCE MATERIALS THAT ENABLE VARIOUS INVENTORY TASKS, PREVENT STORAGE STRUCTURES FROM BEING NEGLIGENTLY LEFT OPEN OR UNLOCKED, PREVENT CIRCUMVENTION OF SECURITY MEASURES, AND ENSURE STABILIZATION OF STORAGE STRUCTURES IN A MOVING MOBILE STRUCTURE, AND PROVIDE AN ALERTING SYSTEM FOR WARNING STAFF OF AN UNSECURE OR UNLOCKED CONDITION OF SUCH STORAGE STRUCTURES

(71) Applicant: The United States of America, as represented by the Secretary of the Navy, Crane, IN (US)

(72) Inventors: Amber Lynn Harmon, Sanford, ME (US); Ellen Marie Galvin, Dover, NH (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/273,823

(22) Filed: Feb. 12, 2019

(65) Prior Publication Data

US 2020/0027613 A1 Jan. 23, 2020

Related U.S. Application Data

(60) Provisional application No. 62/629,146, filed on Feb. 12, 2018.

(51) Int. Cl.

| | |
|---|---|
| ***A47B 81/00*** | (2006.01) |
| ***G21F 5/12*** | (2006.01) |
| ***G21F 5/015*** | (2006.01) |

(52) U.S. Cl.

CPC ..... *G21F 5/125* (2019.01); *A47B 81/00* (2013.01); *G21F 5/015* (2013.01)

(58) Field of Classification Search

CPC ..... A47B 55/00; A47B 81/00; A47B 81/005; A47B 96/00; G21F 5/015; G21F 5/12; G21F 5/125

See application file for complete search history.

(56) References Cited

U.S. PATENT DOCUMENTS 3,018,149 A * 1/1962 Parker ..... A47F 1/126 312/45

3,486,610 A * 12/1969 Warn, Sr. ..... A47B 81/04 206/372

(Continued)

*Primary Examiner* — Wyatt A Stoffa

(74) *Attorney, Agent, or Firm* — Naval Surface Warfare Center, Crane Division; Christopher A. Monsey

(57) ABSTRACT

Apparatuses and methods for securely storing radioactive source materials that enables inventory activities with security functions. In particular, apparatuses and methods for securely storing radioactive source materials are provided with visual and automated inventory, security, alerting, and stabilization design elements that enable various inventory tasks, prevent storage structures from being negligently left open or unlocked, ensure stabilization of storage structures in a moving mobile structure, and provide an alerting system for warning staff of an unsecure or unlocked condition of such storage structures.

12 Claims, 6 Drawing Sheets

(56) References Cited

U.S. PATENT DOCUMENTS 4,359,646 A * 11/1982 Mejia ..... G08B 13/08 307/116
4,399,673 A * 8/1983 Gotanda ..... E05B 17/22 70/276
5,283,546 A * 2/1994 Scop ..... G08B 25/12 340/287
5,483,905 A * 1/1996 Johansson ..... A47B 81/00 109/79
5,577,819 A * 11/1996 Olsen ..... A47B 67/00 312/209
5,668,533 A * 9/1997 Jackson, Jr. ..... H01H 36/0026 335/205
8,539,790 B1 * 9/2013 Budd ..... A01N 1/0252 62/457.9
8,854,180 B2 * 10/2014 Bacarella ..... E05G 1/026 340/5.6
10,259,373 B1 * 4/2019 Stegall ..... B60P 3/34
2004/0090327 A1 * 5/2004 Soloway ..... G08B 13/08 340/545.1
2008/0063338 A1 * 3/2008 Kachmar ..... G08B 13/08 385/13
2008/0128453 A1 * 6/2008 Burckholter ..... B67D 7/34 222/75
2009/0015405 A1 * 1/2009 DiPoala ..... G08B 13/183 340/556
2010/0194563 A1 * 8/2010 Berner ..... G01G 19/52 340/545.1
2010/0328037 A1 * 12/2010 Thomas ..... F25D 29/00 340/10.1
2012/0167646 A1 * 7/2012 Sharma ..... G01D 5/268 70/280
2013/0078876 A1 * 3/2013 Page ..... B63H 21/17 440/6
2018/0291650 A1 * 10/2018 Zabala Zabaleta ..... E05B 47/0012
2019/0313792 A1 * 10/2019 Kusik ..... A47B 73/002
2020/0014889 A1 * 1/2020 Bashkin ..... H04N 7/188

* cited by examiner

REPLACEMENT SHEET

APPARATUSES AND METHODS FOR SECURELY STORING RADIOACTIVE SOURCE MATERIALS THAT ENABLE VARIOUS INVENTORY TASKS, PREVENT STORAGE STRUCTURES FROM BEING NEGLIGENTLY LEFT OPEN OR UNLOCKED, PREVENT CIRCUMVENTION OF SECURITY MEASURES, AND ENSURE STABILIZATION OF STORAGE STRUCTURES IN A MOVING MOBILE STRUCTURE, AND PROVIDE AN ALERTING SYSTEM FOR WARNING STAFF OF AN UNSECURE OR UNLOCKED CONDITION OF SUCH STORAGE STRUCTURES

CROSS-REFERENCE TO RELATED APPLICATION

This application claims priority to U.S. Provisional Application Ser. No. 62/629,146 filed on Feb. 12, 2018, the disclosure of which is expressly incorporated herein by reference.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,491 and 200,507) is assigned to the United States Government and is available for licensing for commercial purposes. Licensing and technical inquiries may be directed to the Portsmouth Naval Shipyard legal office or Technology Transfer Office, Naval Surface Warfare Center Crane, email: Cran_CTO@navy.mil.

FIELD OF THE INVENTION, BACKGROUND, AND SUMMARY OF THE DISCLOSURE

The present invention relates to systems and methods for securely storing radioactive source materials with elements including visual and automated inventory, security, alerting, and stabilization design elements. Various embodiments enable inventory tasks, prevent storage structures from being negligently left open or unlocked, ensure stabilization of storage structures in a moving mobile structure, and provide an alerting system for warning staff of an unsecure or unlocked condition of such storage structures.

Various regulations and laws require organizations that store or use radiological sources to meet a variety of regulatory requirements including ones related to security. For example, such regulations require organizations licensed to possess radiological sources to ensure that all radioactive check sources and standards are properly stored. A variety of problems have been encountered by such organizations in complying with these requirements. For example, users of such sources or standards have negligently left radiological source storage containers open or unlocked and triggered a reporting requirement under such regulations.

Another problem was that existing products available on the market are not suitable for storing such radiological materials for a variety of reasons. For example, combustible material cannot be used in construction of such a container. Also, embodiments of this system needed to be used in confined spaces such as within a submarine where entry/egress into the submarine is limited to specific hatches.

Another difficulty in this design effort was that this invention had to be usable in a moving structure such as a ship or submarine which can take on a significant degree of roll, pitch and yaw during movement. Another problem arose from a need to conduct inventory activities without a need to open the storage container which creates additional risks of negligence with respect to security or distracting crews from other high criticality missions.

Human factors and lack of design to address such human factors were also a major problem given root cause for a variety of security violations. For example, hasp locks were found to be unusable given movement conditions and negligence of users to secure/use the hasp locks. Another design problem was encountered by existing cabinets due to designs susceptible to a condition where the cabinet appeared locked but it was not in fact locked because its door was not fully seated up against the cabinet body. Existing cabinets' door lock designs resulted in a case where the lock appeared to be in a locked position but was not actually engaged with the cabinet's frame.

Another difficulty was a lack of system that was suitable for securing internally stored containers placed therein from movement. Ship movements created risks of damage or contamination particularly with regard to hazardous materials.

Exemplary embodiments that address these problems and needs include an apparatus for securely storing one or more radioactive sources in source containers. Such an embodiment can include an enclosure with removable or moveable shelves coupled or fixed within the enclosure, a hinge coupled to an edge section of sides of the enclosure, and a door coupled to the hinge. The exemplary door can include a frame and a transparent section (e.g., a Plexiglas sheet with a thickness that prevents heavy objects from breaking the sheet). The transparent section is sized to enable external view of objects stored on each removable or moveable shelves from a wide field of view eternal to the enclosure and door. The exemplary apparatus further can include a locking mechanism coupled to the door section and that includes a latching mechanism that selectively engages with a side section of the enclosure adjacent to the door. In at least one embodiment, the exemplary locking mechanism is formed to automatically lock and engage with the enclosure when the door section is rotated to abut a door jamb section of the enclosure. The exemplary locking mechanism can include a key reader and a key etched with a pattern encoded or etched by a laser or another etching machine. The exemplary apparatus can further include a door handle coupled to the door section, a magnet coupled to a section of the enclosure disposed so it magnetically engages the door section to pull the door section against the enclosure when the door section is within a magnetic field of the magnet to thereby reduce potential for failure to engage the lock in a perceived closed position. The exemplary apparatus includes an alarm mechanism system includes an alarm field magnet that couples or mounts with the door section. The alarm system further includes a main alarm body coupled to the enclosure where the alarm system includes a magnetic flux field detection section coupled with an alarm activation section that activates an audible alarm when the alarm field magnet is not adjacent to or within detection range of the magnetic flux field detection section. The exemplary apparatus further includes a tether or tipping prevention section that fixes or tethers the apparatus with respect to an adjacent structure such as a wall.

Additional optional features also addressed a need for automating check in and checkout of radiological sources as well as automating warnings of potential unsafe or unsecure conditions based on an automated system that detects a variety of conditions such as check out time and elapsed time since checkout exceeding various parameters associated with maximum time of use of such radiological sources or materials. Sizing of internal storage structures was also a problem given existing products could not accommodate size of various source containers within the overall storage cabinets shelves.

A variety of methods are used with respect to various embodiments of the invention. For example, various methods including providing an embodiment of an exemplary radiological source cabinet such as disclosed below to include installing the cabinet onto a ship or submarine and tethering the cabinet to a mounting point in the ship or submarine. The ship or submarine then gets under way and begins to move or change orientation in relation to a water body the ship or submarine is operating in and thereby result in force or movement forces being applied to the cabinet which otherwise would cause the cabinet to move but for the tether attaching the cabinet to the chip or submarine's internal spaces. Next, a user would operate various elements of the cabinet to include using a key that is difficult to copy to unlock a spring loaded locking mechanism that is spring loaded to a locking position, opening a door of the cabinet that includes a door alarm which has a protective structure that prevents turning off the door alarm, installing or removing a radioactive source from the cabinet, closing the door to proximity to a door closing assistance magnet that prevents the door from being in physical contact with the cabinet enclosure or jamb area, silencing the door alarm when the door alarm sensor comes into contact or sensing proximity with a door alarm magnet attached to the door, then releasing the key, extracting it which results in the door locking mechanism automatically locking due to a spring loaded lock. Next, an inventory of the radiological sources is conducted by viewing the sources through a transparent section of the cabinet's door, noting a presence or absence of a particular radiological source container that has a predesignated location on shelves inside of the cabinet. Personnel assigned to inventory tasks then inspects the radiological source containers by comparing locations of such sources on an inventory list to predetermined or pre-designated assigned locations on the cabinet's shelves. A variety of additional features or steps can be added including use of automation, detection, additional alarms, tracking, and additional structures such as locking or retention mechanisms that are adapted to receive a uniquely shaped radiological source container (e.g., a uniquely shaped base fits into a correspondingly shaped receiving structure mounted on the shelves).

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
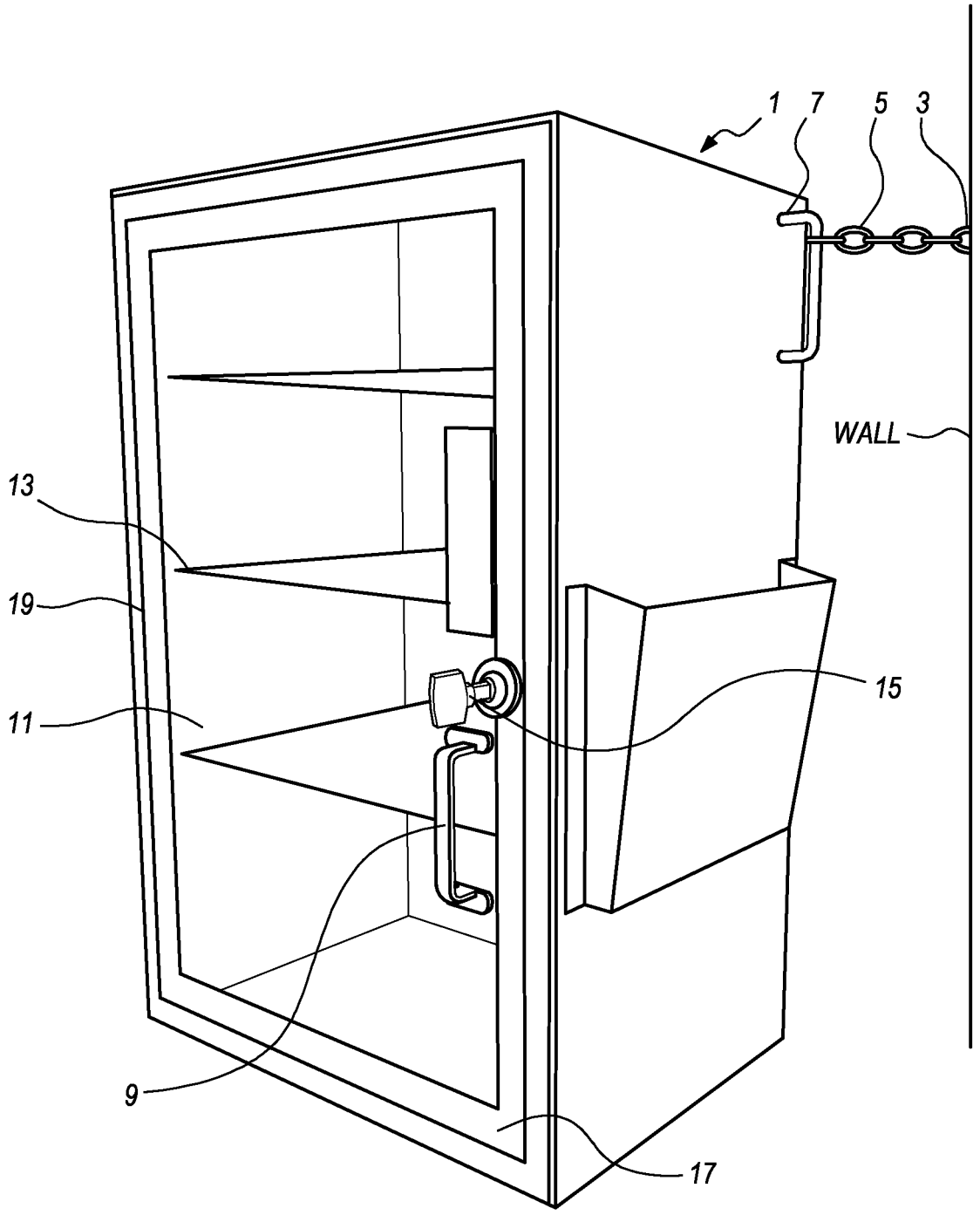
FIG. 1 shows a perspective view on an embodiment of an exemplary radiological source cabinet in a closed position tethered to a wall structure.
Figure 2:
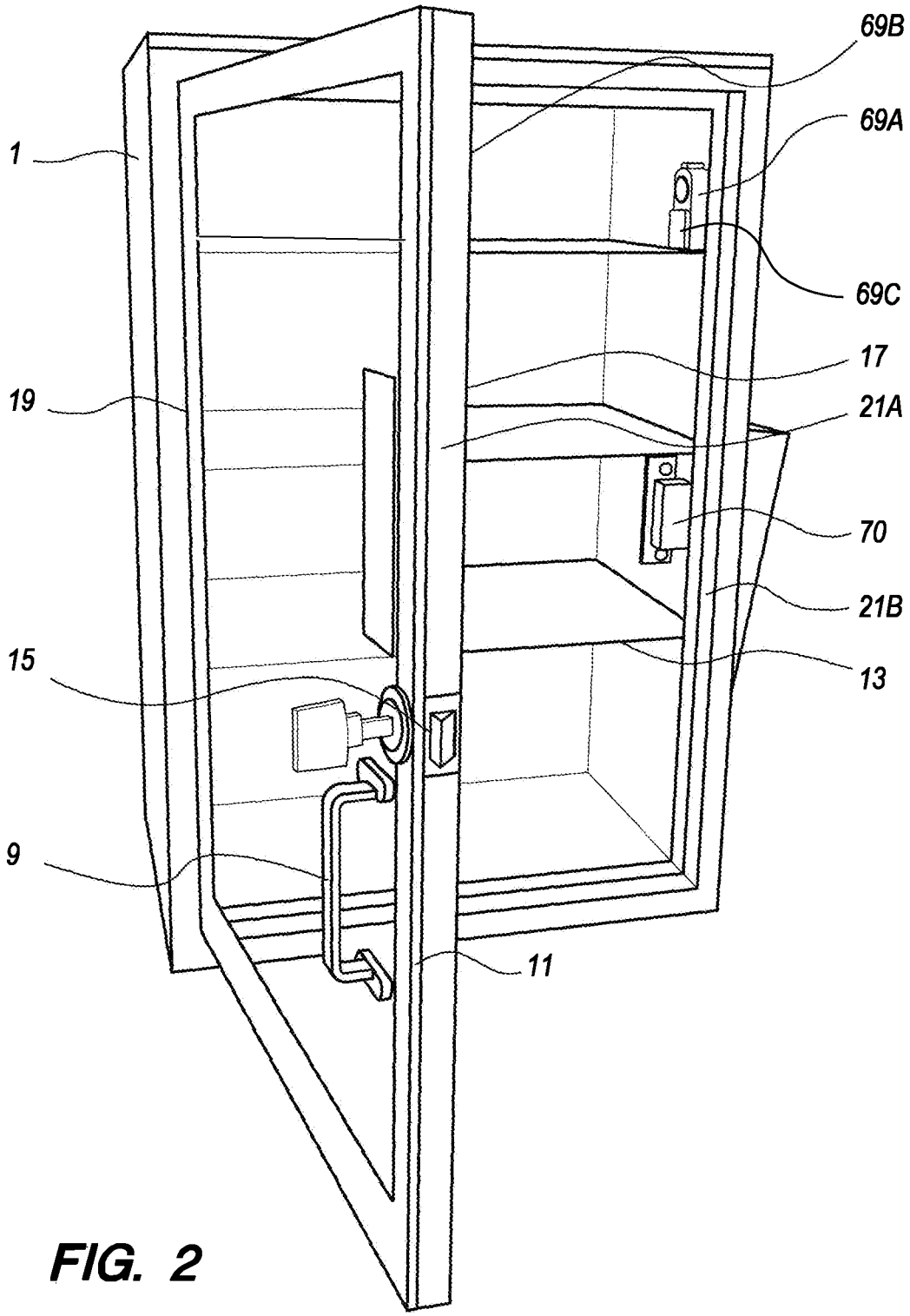
FIG. 2 shows another view of the FIG. 1 embodiment with its door in an open position.

Referring to FIGS. 1 and 2, an exemplary secure radioactive source locker assembly 1 in accordance one embodiment of the invention is shown. The exemplary assembly 1 is formed with enclosing top, bottom, back and side walls and an open front side defined by edges of the left side, right side, and top/bottom walls opposing on a front side opposing the back side. A first attachment/tether structure 3 is coupled to an adjacent structure, in this exemplary case a wall of a submarine (not shown). A second attachment/tether structure 7 is coupled to an external section of the locker assembly 1. An anti-tip chain/tether 5 is coupled on one side to the first attachment/tether structure 3 and on an opposing side to the second attachment/tether structure 7. Alternative mounting systems can be provided such as via bolting of the locker assembly 1 to a floor or wall. A door structure 17 is coupled to a side of the locker assembly 1 using a hinge 19, e.g., a piano hinge, which is operable to enable the door structure 17 to pivot on the hinge 19 and allow access to interior areas of the locker assembly 1. The door structure 17 covers or seals the opening of the locker assembly 1. A door handle 9 is coupled to the door structure 17. The door structure 17 is formed with a transparent Plexiglas, e.g., polycarbonate material, Lexan®, etc transparent material viewing window 11 which is secured within a door frame which the hinge 19 is attached to. The exemplary locker assembly 1 is further provided with moveable or repositionable interior shelves 13. Embodiments can include securing structures (not shown) which fix or lock into position radiological storage containers on the shelves so they do not move when in a mobile structure, e.g., ship is in motion due to maneuvering or sea wave action. A locking structure and key system 15, e.g., MUL-T-Lock® lock and key system, such as for example shown in U.S. Pat. Nos. 5,839,308, 5,784,910, or 5,520,035, is coupled to the door structure 17 which selectively engages and locks with a side section, e.g., right side, of the locker assembly 1. The exemplary locking structure and key system 15 is designed to automatically lock (e.g., spring loaded to a locked position even when a key is inserted) particularly when the door is closed/positioned adjacent to a corresponding side (e.g., right side in this figure when facing the door structure 17) of the locker assembly 1. A magnetic door catch or retaining structure 70 is provided to ensure the door structure 17 is fully seated in a closed position and thereby aid in avoiding a case where the door appears to be locked and secured but is in fact in close proximity to the locker assembly 1 sides but without the locking structure 15 actually engaged and locking onto the locker assembly 1 enclosure frame or side. The exemplary handle 9 can be mounted to the door below the lock with a magnet installed inside the locker to ensure that the door does not move when closed.

Embodiments of this disclosure can include a radiation detection or hazardous material detection system (not shown). This detections system includes detection systems that identify leaks or exposure of hazardous material or radioactive material storage structures within the locker assembly 1. For example, exemplary radiation detection systems can include Gas-filled detectors including Geiger-Muller counters, ionization chambers, radiation survey meters, or proportional counters. The radiation detection system includes a warning system that can emit an audible alarm or transmit a warning signal to an external control station (not shown) which then shows or displays a warning to an operator. An exemplary system can further include automated reader instruments, electronic radiation measuring instruments, alarm badges, or thermoluminescent dosimeters (TLD). Another exemplary embodiment can further include optically stimulated luminescence (OSL) based systems that provide higher accuracy for measurement of low levels of radioactivity. Exemplary embodiments can further include an additive or coating to the door section's transparent section that provide radiation protection. Alternatively, the transparent section can be formed of leaded glass that has a transparent reinforcing coating, such as a plastic coating, that provides protection against breakage of the leaded glass that leaves an opening in the transparent section.

In various embodiments, outer dimensions and shelf heights are at the discretion of a user or requester to accommodate different radiological sources being stored in the exemplary locker assembly 1. In at least one embodiment, a lip or edge 21A of the door structure 17 can be designed to have a minimum of 1" in order to accommodate the locking structure 15 and alarm mechanism 26. The exemplary locker assembly 1 is formed with a door frame section which is formed with an inset section that receives and encloses the door structure 17 so that an outer face of the door section 17 is flush with the door frame section. The exemplary door frame section is also formed with a step or shoulder that the door structure 17 abuts when the door structure 17 is in a closed position within the inset section. The exemplary selected locking structure 15 (e.g., MUL-T-LOCK® drawer latch lock with different keying) that in at least one embodiment removes a need for a lock hasp and staple. The exemplary locking structure 15 function in this embodiment includes a self-locking structure. The key in this embodiment is a laser encoded key with "key card" that has anti-copy design so that unauthorized copies cannot be created. (e.g. see FIG. 5) In this example, a "key card" with key code is issued for each laser encoded key. That key code is associated with a stored laser encoding pattern that must be presented to a secure key production facility to produce and receive another key. In at least some embodiments, the self-locking lock ensures that once the door is closed the locker will be locked. The exemplary locking structure 15 will not allow removal of the key without the locking device being engaged, meaning that the key cannot be removed without the lock being in the locked position.

Exemplary alarm 69A can have alkaline batteries that are replaced periodically, e.g., every 6 months, during the biannual inventory of radiological sources to ensure that the battery life is not a limiting factor. Exemplary alarm system 69A can remain on while the locker is installed and in use. A lockable protective bracket 69C can be installed with respect to alarm 69A to ensure that the alarm will remain in place and the on/off switch cannot be accessed. An exemplary alarm can be used to provide an immediate indication that the door structure 17 remains open, and that the sources are not properly stored. An alarm mechanism 69A is provided, in this case a proximity alarm that detects proximity to a magnetic structure 69B (not visible) coupled with a side section (in this case right side facing the door structure 17). A low battery alarm system can also be included to warn users that the alarm battery is in a low energy state and therefore should be replaced. Such warnings can be a light or audible alarm or notification system.

Figure 3:
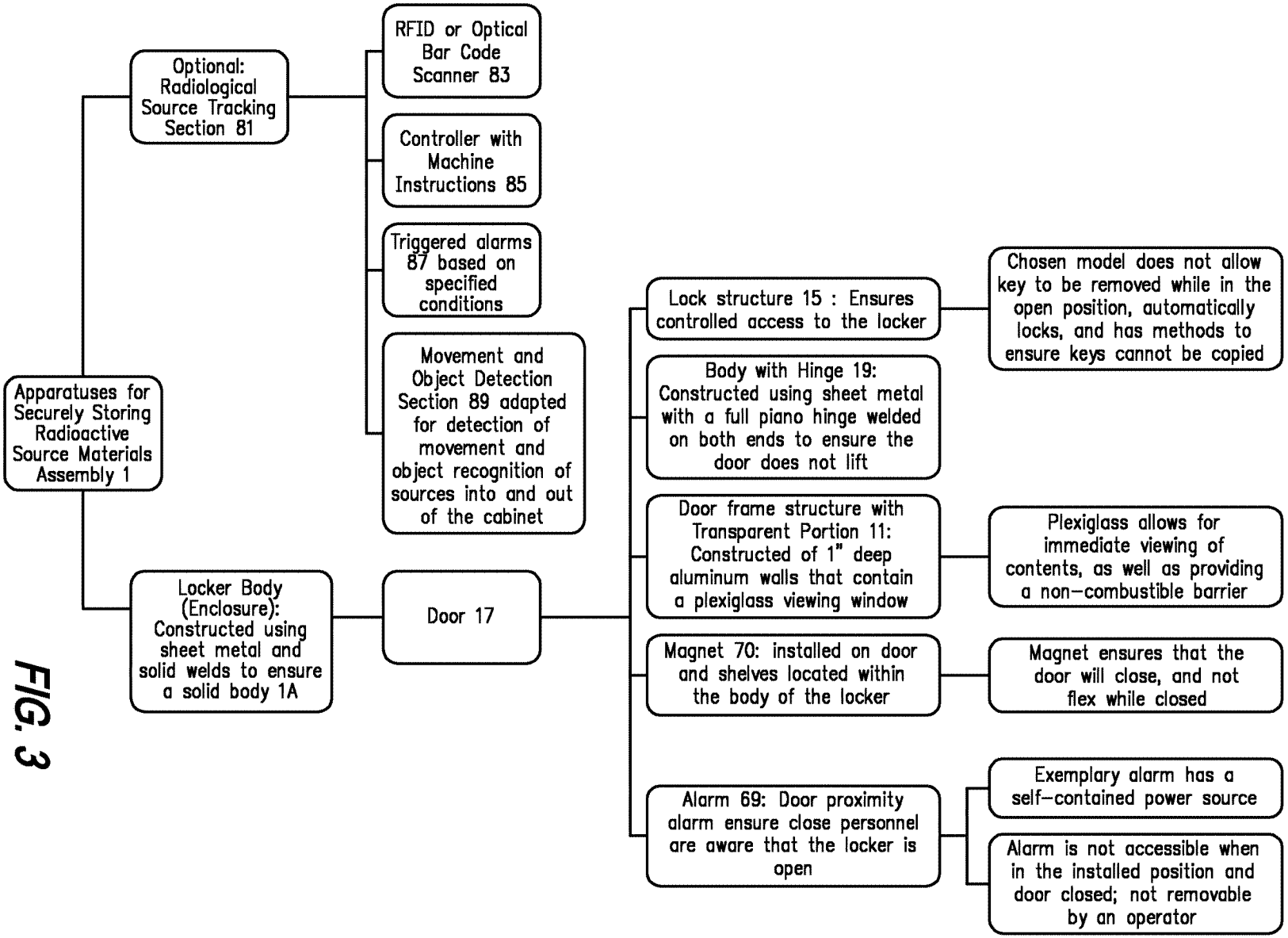
FIG. 3 shows a simplified block diagram of an embodiment of the invention.

FIG. 3 shows a high level or simplified hierarchical block diagram of various components of an embodiment of the invention. An apparatus for securely storing radioactive source materials assembly 1 is provided (e.g., such as in FIGS. 1-2). A locker body is provided with top, bottom, vertical sides coupled to the top and bottom forming an enclosure with an open side (e.g., front side). The locker body can be constructed using sheet metal and solid welds to ensure a solid body enclosure. A door structure 17 is provided coupled to a side of the door body. Locking mechanism 15: Ensures controlled access to the locker 1. This exemplary locking mechanism does not allow the key to be removed while in the open position, automatically locks, and has methods and designs to ensure keys cannot be copied except by an authorized entity. The exemplary enclosure is coupled with door structure 17 with hinge 19. The enclosure is constructed using sheet metal with a full piano hinge 19 welded on both ends to ensure the door does not lift. Transparent components 11: Constructed of 1" deep aluminum walls that holds a Plexiglas viewing window. Plexiglas allows for immediate viewing of contents, as well as providing a non-combustible barrier. Magnet 70: installed on door structure 17 and a frame section or shelves 13 located within the body of the locker assembly. Magnet 70 ensures that the door will close, and not flex while closed. Alarm 69: A proximity alarm 69 ensures close personnel are aware that the locker assembly 1 is open. The alarm 69 can include a self-contained power source. This exemplary alarm 69 is not accessible by a person opening the locker assembly 1 when in the installed position using, e.g., a lockable/removable cover bracket that blocks access to a person accessing the assembly 1 without a cover bracket key.

An optional section can include a radiological source tracking system (RSTS) 81 (not shown). The RSTS 81 system can include one or more of an RFID or optical bar code scanner section 83. The RFID or optical bar code scanner section 83 can detect identifier information associated with materials placed into or removed from the enclosure or locker assembly 1. The RSTS 81 can also include a controller with machine instructions for controlling the RSTS 81 and various elements of the system. The RSTS 81 can further include a triggered alarm 87 which can include a pressure pad or motion detection system placed in front of the cabinet or locker assembly 1 which activates an alarm with a person is in proximity to the assembly 1. The exemplary RSTS 81 can further include a movement and object/feature detection section 89 that has a camera system. The RSTS 81 can include a control system which is either located in the locker assembly 1 or is disposed remotely in communication with the camera system object/feature detection system with, e.g., a neural network feature or object classifier with an associated library of features associated with different objects (e.g., source containers, bar codes or other identifiers associated with particular source containers, access authorization badges or tokens, and facial features of authorized persons who are authorized to unlock the locker assembly 1 and remove source containers) that is adapted to detect movement and object/feature recognition of sources moved into and out of the cabinet or locker assembly 1. The movement and object/feature detection section 89 can further include facial recognition systems which identify persons who are in proximity with or are removing radioactive sources from the automatic locking radioactive source locker assembly 1 then log detected identity information with removal or access actions associated with the radioactive sources. RSTS 81 can further include inventory/removal/access action tracking systems which monitor time elapsed since an object such as a radiation source has been removed or left out of the locker assembly 1. The RSTS 81 can further set off an alarm which causes a search for the removed radiation source that has not been returned to the locker assembly 1 in a predetermined time period. A card reader can also be provided or used to determine if an authorized person or unauthorized person is attempting to open the locker assembly 1. The card reader can be coupled with alarm 69A so that the alarm 69A or the RSTS 81 activates an unauthorized access alarm if the assembly 1 is opened with even with the key.

Figure 4A:
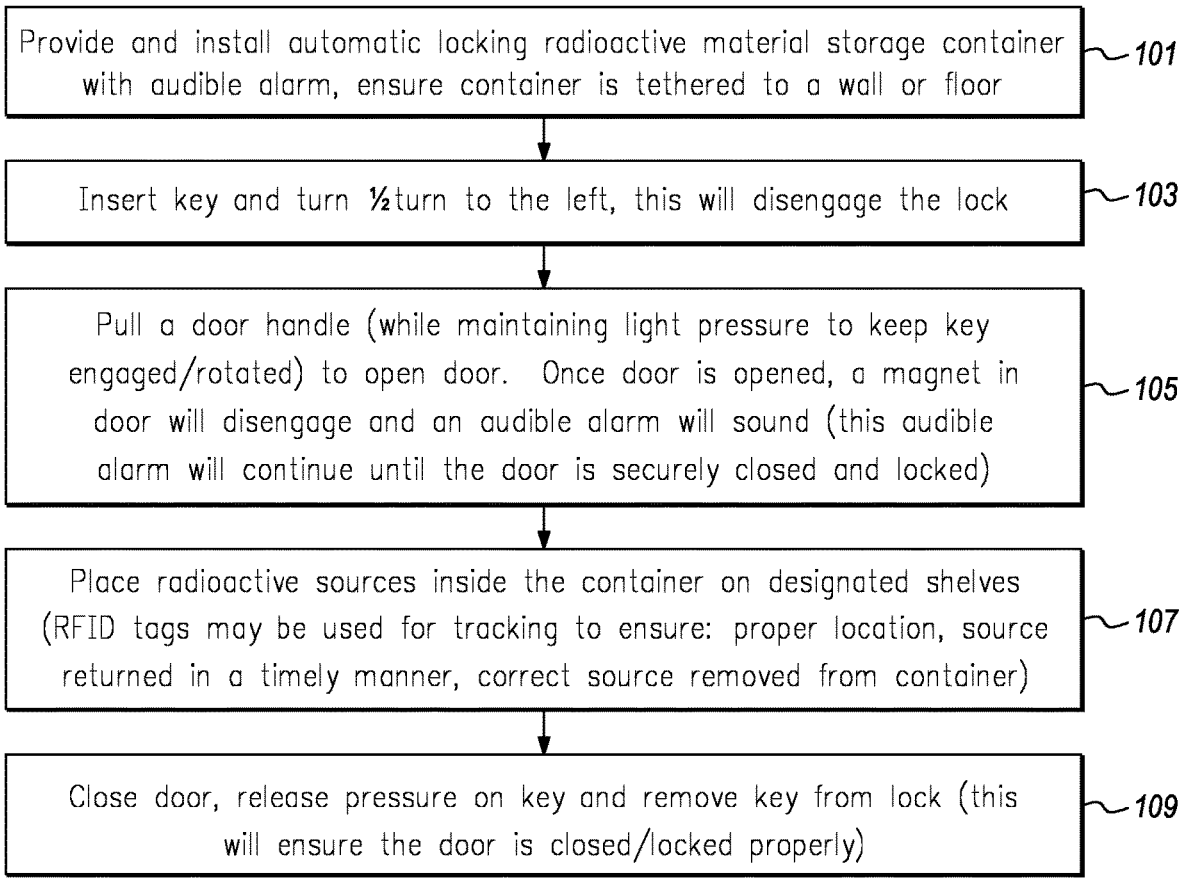
FIG. 4A shows an exemplary method in accordance with one embodiment of the invention.

FIG. 4A shows an exemplary method in accordance with one embodiment of the invention. Step 101: Install automatic locking radioactive source or material storage locker or container into an interior section of a ship or submersible vessel to include tethering the automatic locking radioactive source or material storage locker to a tether mounting section of the ship or vessel such as shown in, e.g., FIGS. 1-3, with audible alarm that activates when the door is opened. At Step 102: Get ship or submersible vessel under weigh whereby the ship or submersible vessel will begin to move in response to ship control inputs or wave motion. At Step 103: Insert a key into the locking mechanism and turn ½ turn to the left and thereby disengage the locking mechanism from engaging with the locker enclosure; Step 105: Pull the door handle (while maintaining light pressure to keep key engaged/rotated) to open door. Once door is opened, the alarm's magnet will move out of detection proximity with the alarm's magnetic flux field detector and an audible alarm will sound (this audible alarm will continue until the locker's door is securely closed and locked); Step 107: Place radioactive sources inside the container on designated shelves (RFID tags may be used for tracking to ensure: proper location, radiological source returned in a timely manner, correct radiological source removed from container); Step 109: Close door, release pressure on key and remove key from lock (this will ensure the door is closed/locked properly).

Figure 4B:
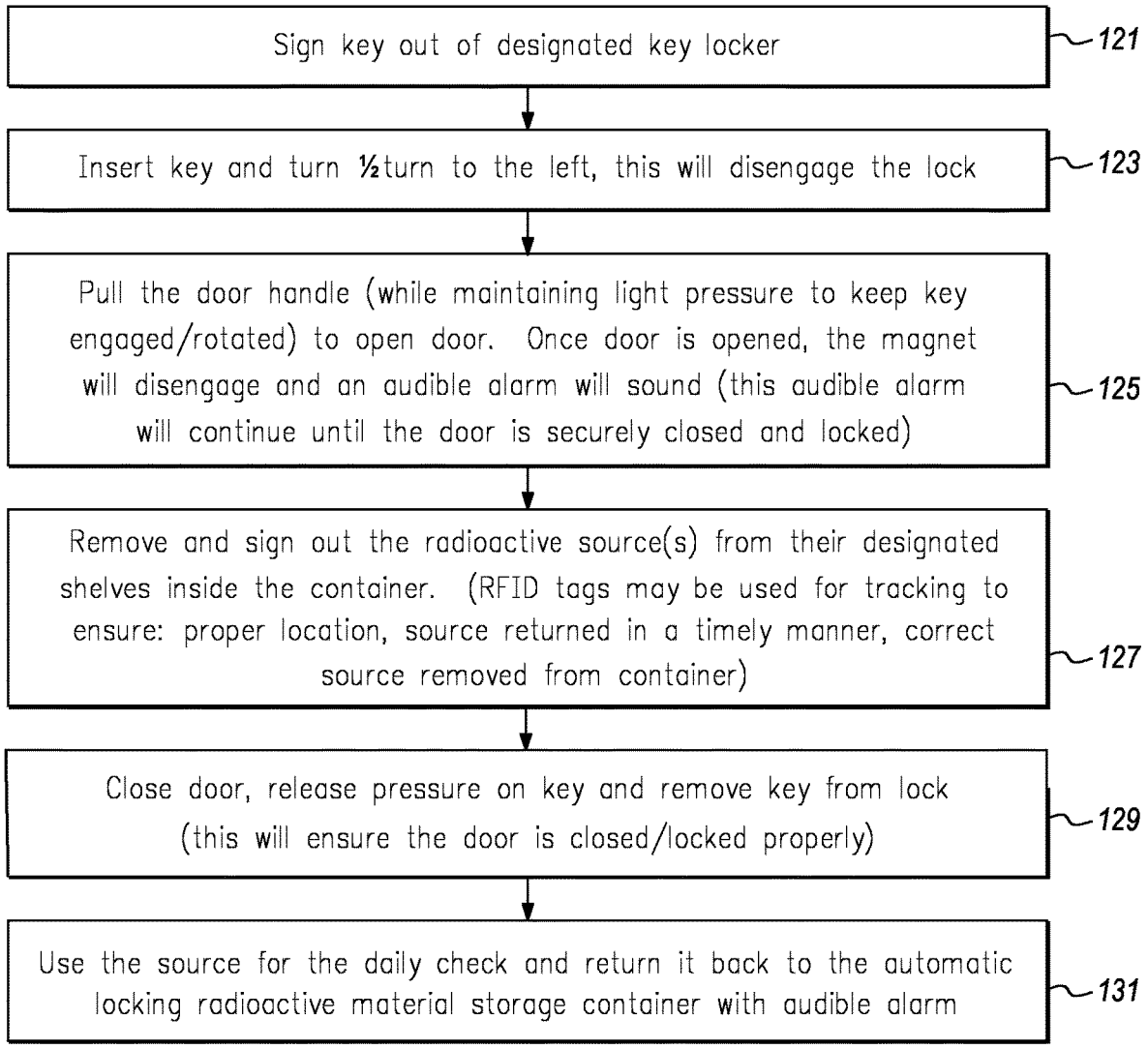
FIG. 4B shows another exemplary method in accordance with one embodiment of the invention.

FIG. 4 B shows a method that is executed once a user is ready to check out a source for daily source check that includes the following steps: Step 121: Sign key out of designated key locker; Step 123: Insert key into locking mechanism and turn ½ turn to the left, this will disengage the lock; Step 125: Pull the door handle (while maintaining light pressure to keep key engaged/rotated) to open door. Once door is opened, the magnet will disengage and an audible alarm will sound (this audible alarm will continue until the door is securely closed and locked); Step 127: Remove and sign out the radioactive source(s) from their designated shelves inside the container. (RFID tags may be used for tracking to ensure: proper location, source returned in a timely manner, correct source removed from container); Step 129: Close door, release pressure on key and remove key from lock (this will ensure the door is closed/locked properly); Step 131: Use the source for a daily check and return radioactive source or sources back to the automatic locking radioactive material storage container with audible alarm by repeating the method at FIG. 4A.

Figure 4C:
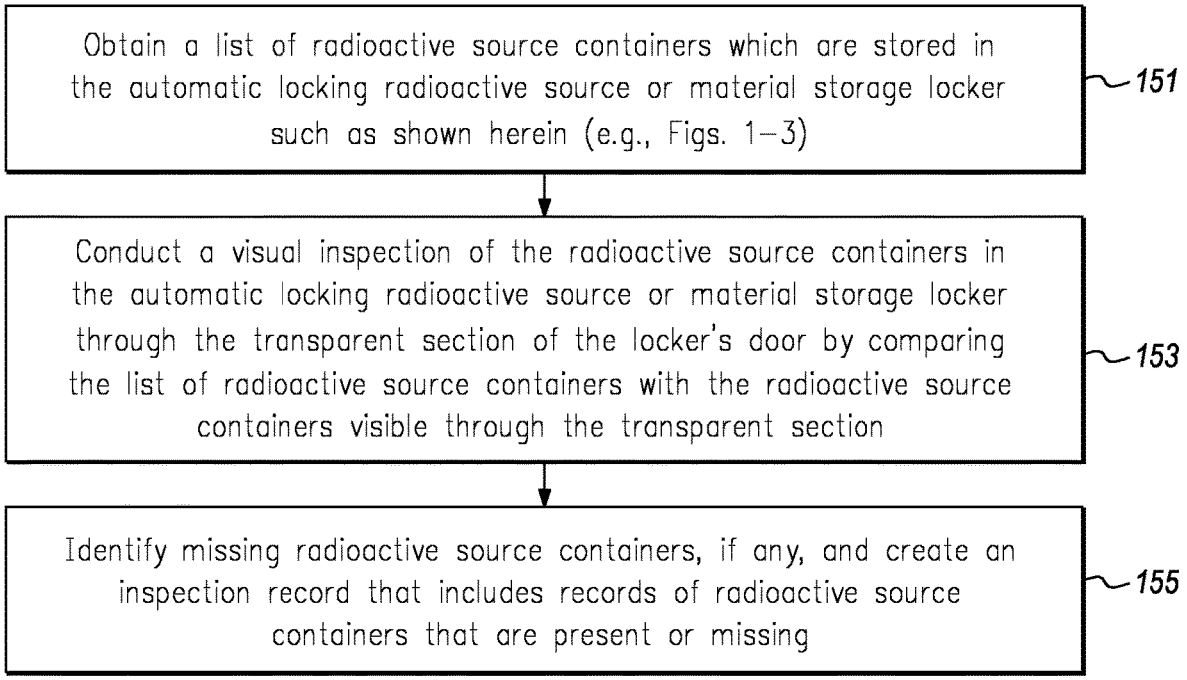
FIG. 4C shows another exemplary method in accordance with one embodiment of the invention.

FIG. 4C shows a method of inspecting for presence or inventorying of the radioactive sources as described herein. At Step 151: Obtain a list of radioactive source containers which are stored in the automatic locking radioactive source or material storage locker such as shown herein (e.g., FIGS. 1-3). At Step 153: conduct a visual inspection of the radioactive source containers in the automatic locking radioactive source or material storage locker through the transparent section of the locker's door by comparing the list of radioactive source containers with the radioactive source containers visible through the transparent section. Step 155: Identify missing radioactive source containers, if any, and create an inspection record that includes records of radioactive source containers that are present or missing.

Figure 5:
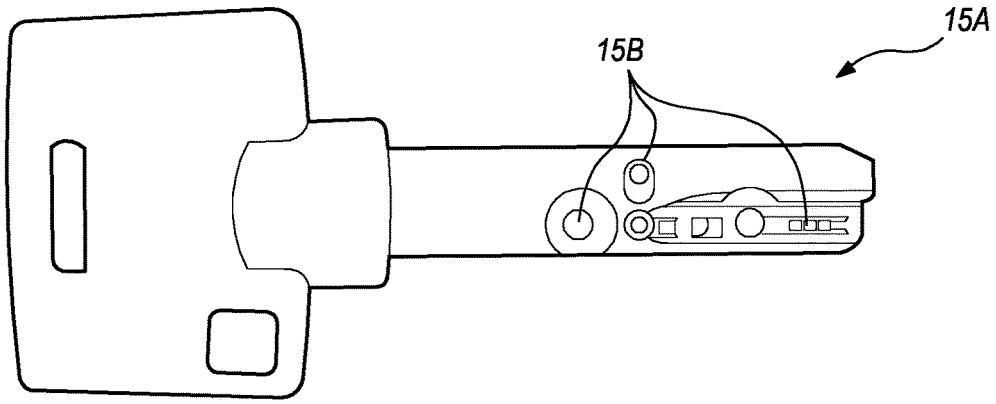
FIG. 5 shows an exemplary etched key used with at least one embodiment of the invention.

Alternative embodiments can include processing steps that include operating RSTS 81 as discussed above. For example, processing steps can include execution of steps such as disclosed with respect to FIGS. 4A-4C where RSTS 81 systems can detect or identify specific radiological sources which are placed into the automatic locking radioactive source or material storage locker assembly 1 and detect when the assembly 1 door has been closed. The RSTS 81 can also track identity as discussed above of persons who perform inventory actions, or access/remove radioactive sources with respect to the locker assembly 1. An additional processing step can include RSTS 81 sending reports of access, inventory, removal, return, unauthorized access, and failure to return radioactive sources to the locker assembly 1 within predetermined time periods warnings to another computer system via a network or wireless connection (not shown) which tracks, reports, and displays status or alarms associated with FIG. 5 shows an exemplary etched key 15A used with at least one embodiment of the invention. An etched section is shown 15B which is associated with a stored etching pattern maintained by a key manufacturing facility via a control number not shown on the key 15A.

An alternative embodiment can include an optional radio frequency identification (RFID) or optical bar code scanner, controller with machine instructions including system for detecting movement of radiological sources into or out of the cabinet and triggering alarms when various conditions are determined (e.g., maximum time period elapsed between removal and return of radiological sources based on RFID or bar code).

Various embodiments can also include shelves that include specific receiving structures that are unique to each of the source containers or are designed for each object/radioactive source. For example, a base of each radiological source container can have a different shape so that the base shape corresponds to a specific radiological source container receiving structure (e.g., square bottom, circular, rectangular, a shape with keyway structures (e.g., one keyway, two keyways, three keyways) that do not permit the wrong structure to be inserted into the source container receiving structure.

Various embodiments enable a quick check to ensure all contents are present, the correct source container is in a specific structure or location and thereby prevents a need to go searching around the locker to try to find it. The door's transparent section enables needed visibility that allows for a full check of all information displayed on the objects/radioactive sources. Verification of in-depth inventory and tracking information without accessing the sources is achieved with various embodiments of the invention.

Although the invention has been described in detail with reference to certain preferred embodiments, variations and modifications exist within the spirit and scope of the invention as described and defined in the following claims.

The invention claimed is:

1. An apparatus for securely storing one or more radioactive sources in source containers within a mobile structure comprising:

an enclosure having a plurality of sides formed with horizontal and vertical sides and a back, the plurality of sides forming an open side;

removable or moveable shelves coupled or fixed within the enclosure;

a hinge coupled to an edge section of one of said horizontal sides;

a door section coupled to said hinge, said door section comprising a frame and a transparent section coupled to the frame which is sized to view each of the removable or moveable shelves;

a locking mechanism coupled to the door section and adapted to selectively engage with the enclosure, wherein the locking mechanism is formed to automatically lock and engage with the enclosure when the door section is rotated to abut door jamb section of the enclosure, wherein the locking mechanism is formed with a key reader and a key etched with a pattern encoded or etched by a laser or another etching machine that is read by the key reader;

a door handle coupled to the door section;

a closing assist magnet coupled to a section of the enclosure disposed so it magnetically engages the door section to pull the door section against the enclosure when the door section is within a magnetic field of the closing assist magnet;

an alarm mechanism comprising a first and second section, wherein the first section comprises a magnet that is coupled to the door section, wherein the second section is coupled to the enclosure, wherein the alarm mechanism has an activation section that activates an audible alarm when the first section is not adjacent to the second section;

a tether section comprising a first and second attachment section and a tether coupler attached to the first and section attachment sections, wherein the first attachment section is coupled to an external section of the enclosure and the second attachments section is adapted to be coupled to an adjacent structure within the mobile structure; and a removable and selectively lockable protective bracket that is coupled with the alarm mechanism to lock the alarm mechanism in place and to obstruct or cover an on/off switch of the alarm mechanism.

2. An apparatus as in claim 1, wherein the mobile structure is a submersible vessel.

3. An apparatus as in claim 1 further comprising an object tracking system disposed within or in proximity with the enclosure comprising a bar code reader or radio frequency identification (RFID) tag reader adapted to read the bar code or RFID tag that is placed on a radiological source object that is removed or inserted into the enclosure.

4. An apparatus as in claim 3, further comprising a tracking computer system that is communicatively coupled with the object tracking system.

5. An apparatus as in claim 1, further comprising said radioactive source containers disposed within the enclosure and placed on said shelves.

6. An apparatus as in claim 5, further comprising locking or retention structures that are coupled with one or more said shelves that includes latching or retention structures that selectively receive and fix in place said radioactive source containers with respect to the shelves.

7. An apparatus as in claim 6, wherein each of the locking or retention structures further comprise a base section that has a different shape, wherein each of the radioactive source containers have a different base section that is each shaped to fit into a corresponding one of the base sections that each have a different shape.

8. An apparatus as in claim 6, wherein each of the radioactive source containers have a first keyway section and each of the locking or retention structures further comprise a second keyway section, wherein the first and second keyway sections are adapted to selectively engage with each other, each of the first and second keyway sections have a corresponding female and male engaging section that fit into each other.

9. An apparatus as in claim 1, wherein said transparent section comprises transparent Plexiglas, polycarbonate material, or leaded glass material.

10. An apparatus as in claim 1, further comprises transparent plastic film adhered to the transparent section.

11. An apparatus for securely storing one or more radioactive sources in source containers within a mobile structure comprising:

an enclosure having a plurality of sides formed with horizontal and vertical sides and a back, the plurality of sides forming an open side;

removable or moveable shelves coupled or fixed within the enclosure;

a hinge coupled to an edge section of one of said horizontal sides;

a door section coupled to said hinge, said door section comprising a frame and a transparent section coupled to the frame which is sized to view each of the removable or moveable shelves;

a locking mechanism coupled to the door section and adapted to selectively engage with the enclosure, wherein the locking mechanism is formed to automatically lock and engage with the enclosure when the door section is rotated to abut door jamb section of the enclosure, wherein the locking mechanism is formed with a key reader and a key etched with a pattern encoded or etched by a laser or another etching machine;

a door handle coupled to the door section;

a first magnet coupled to a section of the enclosure disposed to magnetically engage a side of the door section to pull the door section against the enclosure when the door section is within a magnetic field of magnet;

an alarm mechanism comprising a first and second section, wherein the first section comprises a second magnet that is coupled to the door section, wherein the second section is coupled to the enclosure, wherein the alarm mechanism has an activation section that activates an audible alarm when the first section is not adjacent to the second section;

a tether section comprising a first and second attachment section and a tether coupler attached to the first and section attachment sections, wherein the first attachment section is coupled to an external section of the enclosure and the second attachments section is adapted to be coupled to an adjacent structure within the mobile structure;

an object tracking system disposed within or in proximity with the enclosure comprising a bar code reader or radio frequency identification (RFID) tag reader adapted to read the bar code or RFID tag that is placed on a radiological source object that is removed or inserted into the enclosure;

a tracking computer system that is communicatively coupled with the object tracking system;

a plurality of said radioactive source containers disposed within the enclosure and placed on said shelves; and a plurality of locking or retention structures coupled with said removable or moveable shelves adapted to selectively receive and fix in place said radioactive source containers;

a removable and selectively lockable protective bracket that is coupled with the alarm mechanism to lock the alarm mechanism in place and to obstruct or cover an on/off switch of the alarm mechanism;

wherein each of the locking or retention structures further comprise a base section that has a different shape, wherein each of the radioactive source containers have a different base section that is each shaped to fit into a corresponding one of the base sections that each have a different shape;

wherein the mobile structure is a ship or submersible vessel.

12. A method of using a storage apparatus for securely storing radioactive source comprising:

providing a mobile structure that is either a shop or submersible vessel;

providing an apparatus for storage of radioactive sources, said apparatus comprising:

an enclosure having a plurality of sides formed with horizontal and vertical sides and a back, the plurality of sides forming an open side;

a plurality of removable or moveable shelves coupled or fixed within the enclosure;

a hinge coupled to an edge section of one of said horizontal sides;

a door section coupled to said hinge, said door section comprising a frame and a transparent section coupled to the frame which is sized to view each of the removable or moveable shelves;

a door handle coupled to the door section;

a first magnet coupled to a section of the enclosure disposed so it magnetically engages the door section to pull the door section against the enclosure when the door section is within a magnetic field of the first magnet;

a locking mechanism coupled to the door section and adapted to selectively engage with the enclosure, wherein the locking mechanism is formed to automatically lock and engage with the enclosure when the door section is rotated to abut a door jamb section of the enclosure, wherein the locking mechanism is formed with a key reader and a key etched with a pattern encoded or etched by a laser or another etching machine that is read by the key reader;

an alarm mechanism comprising a first and second section, wherein the first section comprises a magnet that is coupled to the door section, wherein the second section is coupled to the enclosure, wherein the alarm has an activation section that activates an audible alarm when the first section is not adjacent to the second section; and a tether section comprising a first attachment section and a tether coupler attached to the first attachment sections;

providing a submersible vessel with an interior compartment formed with a plurality of wall sections, wherein a second attachment section is coupled with one of the wall sections, wherein the first attachment section is coupled to the second attachment section by the tether coupler;

operating the submersible vessel to transit a first section of water and thereby altering an orientation of the interior compartment with respect to a gravitational vector;

inserting said key and disengaging the locking mechanism;

pulling the door handle while maintaining a first force on the key to keep the key engaged/rotated to open the door section, wherein once the said door section is opened, the second magnet moves out of detection range of the alarm mechanism and thereby causing the alarm mechanism to generate a continuous audible alarm sound that will sound and continue until the door is securely closed and locked;

placing the radioactive source inside the enclosure on one of the shelves and into a source receiving section that fixes the radioactive source into a fixed position;

closing the door section and releasing pressure on the key so the rotates into a spring loaded locked position then removing the key from the locking mechanism;

conducting an inventory of the one or more radiological sources by viewing the radiological sources through the transparent section and determining if the radiological sources are present within the enclosure while the door section is in a closed position;

when a user is ready to remove the radioactive source, obtaining the key from a locked storage container;

inserting the key into the locking mechanism and disengaging the locking mechanism from engagement with the enclosure;

pulling the door handle while maintaining light pressure to keep key engaged/rotated to rotate and open the door, wherein once door is opened, the magnet will disengage and the audible alarm will sound and continue until the door section is closed and locked by the locking mechanism;

removing the radioactive source from one of the shelves inside the enclosure; and closing the door section, thereby deactivating the alarm; and releasing pressure on the key and removing the key from the locking section.

* * * * *